United States Patent [19]

Stoltman

[11] 4,196,707

[45] Apr. 8, 1980

[54] EXHAUST GAS RECIRCULATION CONTROL

[75] Inventor: Donald D. Stoltman, Henrietta, N.Y.

[73] Assignee: General Motors Corporation, Detroit, Mich.

[21] Appl. No.: 929,653

[22] Filed: Jul. 31, 1978

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,756,210 | 9/1973 | Kuehl | 123/119 A |
| 3,762,384 | 10/1973 | Day et al. | 123/119 A |
| 3,783,848 | 1/1974 | Ranft | 123/119 A |
| 3,791,360 | 2/1974 | Rieger | 123/119 A |
| 3,799,131 | 3/1974 | Bolton | 123/119 A |
| 3,800,765 | 4/1974 | Thompson | 123/119 A |
| 3,802,402 | 4/1974 | Swatman | 123/119 A |
| 3,834,363 | 9/1974 | Goto et al. | 123/119 A |
| 3,834,366 | 9/1974 | Kingsbury | 123/119 A |
| 3,844,261 | 10/1974 | Garcea | 123/119 A |
| 3,880,129 | 4/1975 | Harris, Jr. | 123/119 A |
| 3,881,456 | 5/1975 | Nohira et al. | 123/119 A |
| 3,896,777 | 7/1975 | Masaki et al. | 123/119 A |
| 3,928,966 | 12/1975 | Goto et al. | 123/119 A X |
| 3,931,813 | 1/1976 | Horie et al. | 123/119 A |
| 3,974,807 | 8/1976 | Nohira et al. | 123/119 A |
| 3,982,515 | 9/1976 | Bradshaw | 123/119 A |
| 4,027,638 | 6/1977 | Moriya et al. | 123/119 A |
| 4,031,871 | 6/1977 | Hamanishi | 123/119 A |
| 4,041,917 | 8/1977 | Suzuki | 123/119 A |
| 4,044,735 | 8/1977 | Sumiyoshi | 123/119 A |
| 4,069,797 | 1/1978 | Nohira et al. | 123/119 A |
| 4,069,798 | 1/1978 | Thornburgh | 123/119 A |
| 4,079,710 | 3/1978 | Moriya et al. | 123/119 A |
| 4,090,482 | 5/1978 | Yoshida | 123/119 A |
| 4,092,960 | 6/1978 | Nohira et al. | 123/119 A |
| 4,094,287 | 6/1978 | Nohira | 123/119 A |
| 4,098,246 | 7/1978 | Noguchi et al. | 123/119 A |
| 4,100,734 | 7/1978 | Ozaki et al. | 123/119 A X |
| 4,112,894 | 9/1978 | Nohira | 123/119 A |
| 4,114,577 | 9/1978 | Aoyama | 123/119 A |

FOREIGN PATENT DOCUMENTS

| | | | |
|---|---|---|---|
| 1380046 | 1/1971 | United Kingdom | 123/119 A |

OTHER PUBLICATIONS

Research Disclosure, Item 15212, In application Pate, Dec. 1976.

*Primary Examiner*--Wendell E. Burns
*Attorney, Agent, or Firm*—C. K. Veenstra

[57] ABSTRACT

A regulating unit senses the pressures in two zones of a recirculation passage to create a control pressure, and a transducer regulates an operating pressure which positions a control valve to provide exhaust gas recirculation at rates which establish the pressures in the zones necessary to maintain the control pressure equal to a reference pressure. Exhaust gas recirculation thus varies with engine exhaust backpressure and accordingly is a proportion of induction air flow with the proportion being ruled by the regulating unit.

28 Claims, 3 Drawing Figures

EXHAUST GAS RECIRCULATION CONTROL

Figure 1:
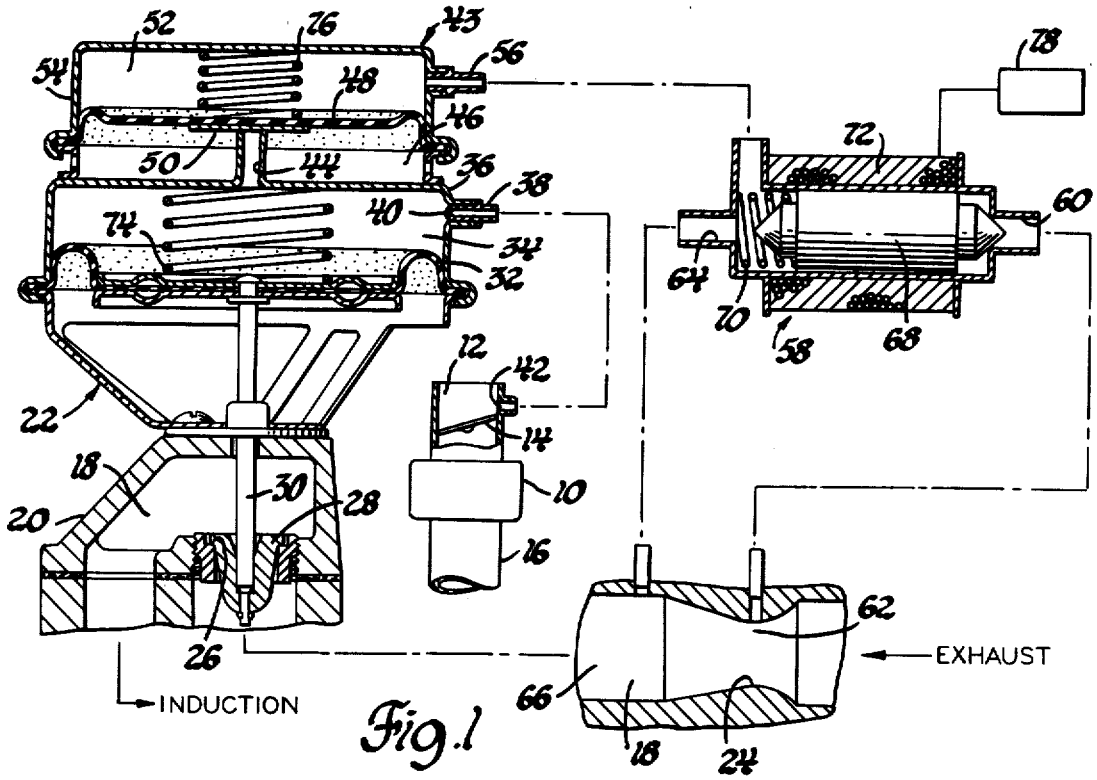

This invention relates to control of exhaust gas recirculation and provides a novel assembly and method for controlling exhaust gas recirculation in proportion to induction air flow and for changing the proportion for selected operating conditions.

Recirculation of exhaust gases has been developed as a method for inhibiting formation of oxides of nitrogen during the combustion process in an internal combustion engine. In general, it is desired to recirculate exhaust gases at a rate proportional to the rate of induction air flow. To accomplish that purpose, exhaust gas recirculation (EGR) control assemblies have included an EGR control valve pintle positioned to provide exhaust gas recirculation at rates which maintain the pressure in the EGR passage upstream of the pintle equal to a reference pressure. Recirculation of exhaust gases has thus been varied with exhaust backpressure, which in turn varies as a function of induction air flow, to provide exhaust gas recirculation substantially proportional to induction air flow.

Such prior EGR control assemblies generally included a transducer for regulating a subatmospheric operating pressure by which the control valve pintle was positioned. The transducer employed an air bleed valve to regulate the operating pressure—opening an air bleed to increase the operating pressure which caused the control valve pintle to reduce exhaust gas recirculation when the induction air flow (and thus the engine exhaust backpressure) decreased and the control pressure accordingly started to fall below the reference pressure, and closing the air bleed which reduced the operating pressure and caused the control valve pintle to increase exhaust gas recirculation when the induction air flow (and thus the engine exhaust backpressure) increased and the control pressure accordingly started to rise above the reference pressure. The bleed valve was carried on a control diaphragm subjected on one side to the control pressure in the EGR passage and balanced by atmospheric pressure on the opposite side and by the bias of a spring or other force producing member; the combination of atmospheric pressure and the spring or other bias formed the reference pressure.

Various controls have been used to cancel the operating pressure used by such assemblies and thus entirely preclude exhaust gas recirculation under conditions such as idle, wide open throttle and low temperature operation. For other selected conditions such as heavy load operation, however, it may be desired to provide exhaust gas recirculation in relatively high proportion to induction air flow, while for conditions such as light load operation it may be desired to provide exhaust gas recirculation in relatively low proportion to induction air flow. Yet with the prior EGR control assemblies, the proportion could be changed only by changing the reference pressure or by using a third valve element to adjust the area of the EGR passage upstream of the control valve pintle.

This invention provides an improved EGR control which allows changes in the proportion of the exhaust gases recirculated without changing the reference pressure or adjusting the area of the EGR passage upstream of the control valve. With the improved EGR control of this invention, a regulating unit senses the pressures in two zones of the EGR passage and applies the pressures either alternately or in combination to create a control pressure, and a control valve is positioned to provide exhaust gas recirculation at rates which establish the pressures in the EGR passage zones necessary to create a control pressure equal to a reference pressure.

In one embodiment of this invention, a regulating valve senses the pressure in one zone of the EGR passage during certain engine operating conditions and senses the pressure in another zone of the EGR passage during other operating conditions, and a control valve is positioned to provide exhaust gas recirculation at rates which maintain the selected pressure equal to a reference pressure. The proportion of exhaust gas recirculation to induction air flow will be higher when the pressure in one zone of the EGR passage is balanced with the reference pressure than when the pressure in the other zone is balanced with that reference pressure.

In another embodiment of this invention, a regulating valve creates a control pressure intermediate the pressures in the two zones by pulse width modulating ports opening to the two zones, and a control valve is positioned to provide exhaust gas recirculation at rates which establish the pressures in the two zones necessary to maintain the control pressure equal to a reference pressure. The proportion of exhaust gas recirculation to induction air flow will vary with the duty cycle.

From the foregoing, it may be understood that this invention provides exhaust gas recirculation in proportion to induction air flow and changes the proportion by creating an appropriate control pressure; the prior proposals could change the proportion only by changing the reference pressure or by adjusting the area of the EGR passage upstream of the control valve.

Figure 2:
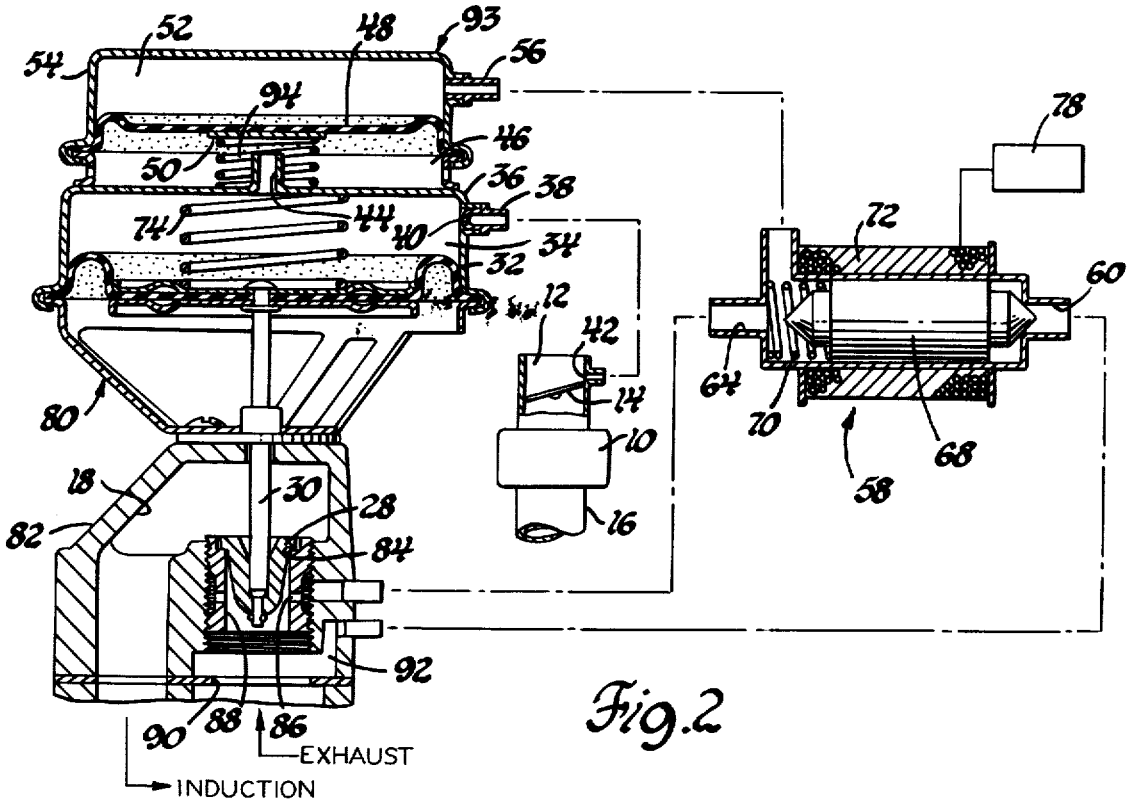
Figure 3:
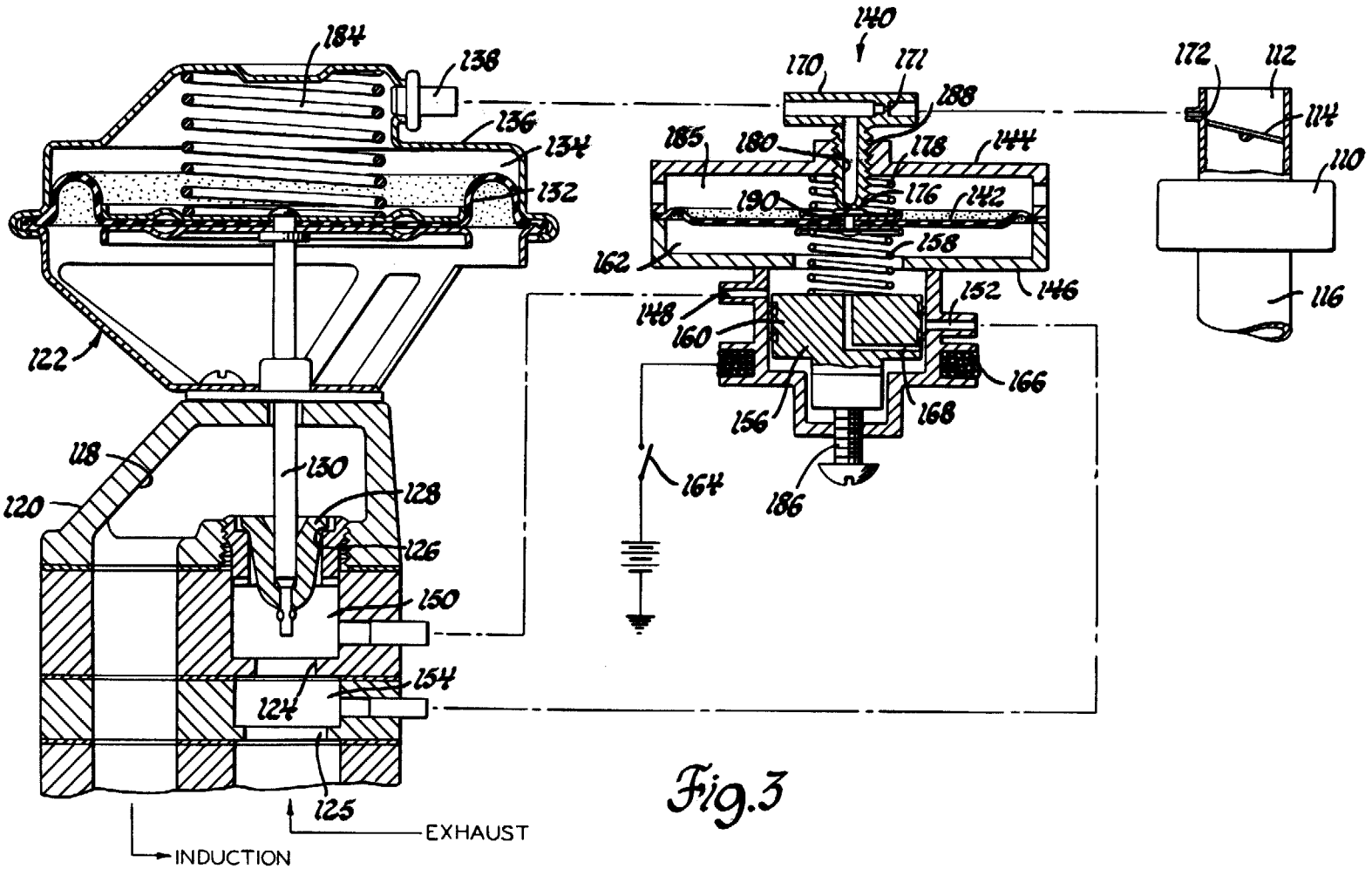

The details as well as other features and advantages of this invention are set forth in the remainder of the specification and are shown in the drawings, in which:

FIG. 1 is a schematic view of an exhaust gas recirculation control system employing one embodiment of this invention in which a regulating valve senses the pressures at zones formed by the throat and the outlet of a venturi in the EGR passage;

FIG. 2 is a schematic view of an exhaust gas recirculation control system employing another embodiment of this invention in which a regulating valve senses the pressures in zones formed by orifices in the EGR passage; and FIG. 3 is a schematic view of an exhaust gas recirculation control system employing the improved embodiment of this invention set forth in co-pending application Ser. No. 940,079 filed Sept. 6, 1978 in the names of R. J. Haka and D. D. Stoltman.

Referring first to FIG. 1, an internal combustion engine 10 has an air induction passage 12, a throttle 14 controlling induction air flow through passage 12, and an exhaust passage 16. An exhaust gas recirculation (EGR) passage 18 extends from exhaust passage 16 through the body 20 of an EGR control unit 22 and then to induction passage 12 downstream of throttle 14.

A venturi 24 is formed in EGR passage 18 upstream of a valve seat 26. A control valve pintle 28 is associated with valve seat 26 and has a stem 30 extending to an operating diaphragm 32. Diaphragm 32 defines a portion of an operating pressure chamber 34 closed by a cover 36.

Cover 36 has a fitting 38 with an aperture 40 for sensing the pressure signal created at a port 42 in induction passage 12 adjacent the edge of throttle 14. Aperture 40 senses the subatmospheric induction passage pressure downstream of throttle 14 during open throttle operation and the substantially atmospheric pressure upstream of throttle 14 during idle and other closed throttle modes of operation.

Cover 36 also forms a portion of a transducer 43 having an air bleed 44 opening into operating pressure chamber 34 from a chamber 46 open to air at atmospheric pressure. Transducer 43 includes a control diaphragm 48 which carries a bleed valve 50 to control flow through air bleed 44. Control diaphragm 48 forms a portion of a control pressure chamber 52 closed by a cover 54. Cover 54 has a fitting 56 for sensing the control pressure created by a regulating unit 58.

Regulating unit 58 has a port 60 sensing the pressure in the restricted zone 62 of EGR passage 18 formed by the throat of venturi 24 and another port 64 sensing the pressure created in the expanded zone 66 of EGR passage 18 at the outlet of venturi 24. A regulating valve 68 is biased by a spring 70 to cause regulating unit 58 to deliver the pressure from one of the zones, here shown as zone 66, to control pressure chamber 52, but a solenoid coil 72 may be energized to displace regulating valve 68 against the bias of spring 70 and apply the pressure in zone 62 to control pressure chamber 52.

During operation when coil 72 is not energized, any decrease in pressure in zone 66 is sensed in control pressure chamber 52, and control diaphragm 48 is raised against the bias of a spring 76, moving bleed valve 50 away from bleed 44 to permit air flow through bleed 44 into chamber 34. The increased operating pressure in chamber 34 then allows a spring 74 to lower operating diaphragm 32 and control valve pintle 28 toward valve seat 26. The resulting decrease in the exhaust gas recirculation area between control valve pintle 28 and valve seat 26 reduces exhaust gas recirculation, and the pressure in zone 66 increases to balance the control pressure in chamber 52 with the reference pressure created by the bias of spring 76 and atmospheric pressure in chamber 46.

Upon an increase in pressure in zone 66, control diaphragm 48 lowers bleed valve 50 to obstruct air flow through bleed 44. The operating pressure in chamber 34 is then reduced by the subatmospheric pressure signal sensed through aperture 40, and operating diaphragm 32 is raised against the bias of spring 74 to lift control valve pintle 28 from valve seat 26. The resulting increase in the exhaust gas recirculation area provides increased exhaust gas recirculation, and the pressure in zone 66 decreases to balance the control pressure in chamber 52 with the reference pressure.

Thus when coil 72 is not energized, EGR control unit 22 positions control valve pintle 28 to provide exhaust gas recirculation at rates which establish the pressure in zone 66 necessary to maintain the control pressure in chamber 52 equal to the reference pressure.

When the pressure in zone 66 equals the reference pressure, the flow of exhaust gases into zone 66 varies as a function of the exhaust backpressure in passage 16. Since the exhaust backpressure is a function of the flow through engine 10—that is, a function of the exhaust gas flow through passage 16 and thus the induction air flow through passage 12—exhaust gas recirculation through EGR passage 18 will be proportional to induction air flow through passage 12.

When coil 72 is energized, regulating unit 58 applies the pressure from zone 62 to control pressure chamber 52, and EGR control unit 22 then positions control valve pintle 28 to provide exhaust gas recirculation at rates which establish the pressure in zone 62 necessary to maintain the control pressure in chamber 52 equal to the reference pressure. Since higher flows through venturi 24 are required to achieve a particular pressure in outlet zone 66 than to achieve that pressure in throat zone 62, exhaust gas recirculation will be a higher proportion of induction air flow when regulating unit 58 directs the pressure from outlet zone 66 to control pressure chamber 52 than when regulating unit 58 directs the pressure from throat zone 62 to control pressure chamber 52.

If desired, an electronic control unit 78 may energize coil 72 according to a duty cycle having a pulse width determined by engine operating conditions. Regulating unit 58 then will modulate flow through ports 60 and 64 to create a control pressure for chamber 52 which is intermediate the pressures in zones 62 and 66 and, when regulating unit 58 is connected as shown, which varies inversely with the portion of the duty cycle over which coil 72 is energized. EGR control unit 22 then positions control valve pintle 28 to provide exhaust gas recirculation at rates which establish the pressures in zones 62 and 66 necessary to maintain the control pressure in chamber 52 equal to the reference pressure. Exhaust gas recirculation thus may be provided at any proportion between the proportion achieved when coil 72 is not energized (0% duty cycle) and the proportion achieved when coil 72 is continuously energized (100% duty cycle), and the proportion is ruled by the duty cycle modulation of ports 60 and 64.

FIG. 2 illustrates another embodiment of this invention similar in certain respects to that of FIG. 1, and identical reference numerals are used to identify identical parts. Referring to FIG. 2, an EGR control unit 80 has a body 82 defining a portion of EGR passage 18. A valve seat 84 is mounted in valve body 82 and forms a small orifice in EGR passage 18. Port 64 of regulating unit 58 is connected to a tap 86 for sensing the pressure in a restricted zone 88 defined by valve seat 84. A large orifice member 90 is disposed in EGR passage 18 upstream of valve seat 84 to define a relatively unrestricted zone 92 therebetween. Port 60 of regulating unit 58 senses the pressure in zone 92.

During operation when coil 72 is not energized, any increase in pressure in zone 88 is sensed by control pressure chamber 52 in the transducer 93, and control diaphragm 48 lowers bleed valve 50 against the bias of a spring 94 to obstruct air flow through bleed 44. The operating pressure in chamber 34 is then reduced by the subatmospheric pressure signal sensed through aperture 40, and operating diaphragm 32 is raised against the bias of spring 74 to lift control valve pintle 28 from valve seat 84. The resulting increase in the exhaust gas recirculation area between control valve pintle 28 and valve seat 84 provides increased exhaust gas recirculation, and the pressure in zone 88 decreases to balance the control pressure in chamber 52 with the reference pressure created by the bias of spring 94 and atmospheric pressure in chamber 46.

Upon a decrease in pressure in zone 88, control diaphragm 48 lifts bleed valve 50 away from bleed 44 to permit air flow through bleed 44 into chamber 34. The increased operating pressure in chamber 34 then allows spring 74 to lower operating diaphragm 32 and control valve pintle 28 toward valve seat 84. The resulting decrease in the exhaust gas recirculation area reduces exhaust gas recirculation, and the pressure in zone 88 increases to balance the control pressure in chamber 52 with the reference pressure.

Thus when coil 72 is not energized, EGR control unit 80 positions control valve pintle 28 to provide exhaust gas recirculation at rates which establish the pressure in zone 88 necessary to maintain the control pressure in chamber 52 equal to the reference pressure and thus provide exhaust gas recirculation as a proportion of induction air flow.

When coil 72 is energized, the regulating unit 58 applies the pressure from zone 92 to control pressure chamber 52, and EGR control unit 80 positions control valve pintle 28 to provide exhaust gas recirculation at rates which establish the pressure in zone 92 necessary to maintain the control pressure in chamber 52 equal to the reference pressure. Since the entrance to zone 88 is more restricted than the entrance to zone 92, exhaust gases will be recirculated at a lower rate when the pressure in zone 88 equals a reference pressure than when the pressure in zone 92 equals that reference pressure. Thus exhaust gas recirculation will be a higher proportion of induction air flow when regulating unit 58 directs the pressure from unrestricted zone 92 to control pressure chamber 52 than when regulating unit 58 directs the pressure from restricted zone 88 to control pressure chamber 52.

If desired, an electronic control unit 78 may energize coil 72 according to a duty cycle having a pulse width determined by engine operating conditions. Regulating unit 58 then will modulate flow through ports 60 and 64 to create a control pressure for chamber 52 which is intermediate the pressures in zones 88 and 92 and, when regulating unit 58 is connected as shown, which varies directly with the portion of the duty cycle over which coil 72 is energized. EGR control unit 80 then positions control valve pintle 28 to provide exhaust gas recirculation at rates which establish the pressures in zones 88 and 92 necessary to maintain the control pressure in chamber 52 equal to the reference pressure. Exhaust gas recirculation thus may be provided at any proportion between the proportion achieved when coil 72 is not energized (0% duty cycle) and the proportion achieved when coil 72 is continuously energized (100% duty cycle), and the proportion is ruled by the duty cycle modulation of ports 60 and 64.

It will be appreciated that regulating unit 58 also may create a control pressure by duty cycle modulation of the pressure in any of EGR passage zones 62, 66, 88 and 92 with the pressure in another zone such as a zone of atmospheric pressure or a zone of subatmospheric or superatmospheric pressure and that the EGR control unit would then position control valve pintle 28 to provide exhaust gas recirculation at rates which establish the pressure in the EGR passage zone necessary to maintain the control pressure equal to the reference pressure.

It also will be appreciated that regulating unit 58 may be employed to modulate flow through ports 60 and 64 on a continuous or proportional basis instead of the either-or and the duty cycle bases described above.

The operating pressure in chamber 34 is at times dependent upon the subatmospheric induction passage pressure signal received from port 42. During closed throttle operation, port 42 senses the substantially atmospheric pressure upstream of throttle 14, and spring 74 engages control valve pintle 28 with its valve seat to interrupt exhaust gas recirculation. During wide open throttle operation, the pressure in induction passage 12 downstream of throttle 14 approaches atmospheric pressure, and spring 74 again engages control valve pintle 28 with its valve seat to interrupt exhaust gas recirculation. During a range of part throttle operation, however, variations in the induction passage pressure downstream of throttle 14 do not affect exhaust gas recirculation—for if the operating pressure in chamber 34 causes operating diaphragm 32 to move control valve pintle 28 from that position which provides exhaust gas recirculation at the rate establishing the pressures in EGR passage 18 necessary to maintain the control pressure in chamber 52 equal to the reference pressure, the transducer will restore the operating pressure in chamber 52 to the level necessary to return control valve pintle 28 to that position.

FIG. 3 illustrates another embodiment of this invention in which the transducer is separate from the EGR control valve structure. Referring to FIG. 3, an internal combustion engine 110 has an air induction passage 112, a throttle 114 controlling induction air flow through passage 112, and an exhaust passage 116. An EGR passage 118 extends from exhaust passage 116 through the body 120 of an EGR control unit 122 and then to induction passage 112 downstream of throttle 114.

A pair of orifices 124 and 125 are disposed in EGR passage 118 upstream of a valve seat 126. A control valve pintle 128 is associated with valve seat 126 and has a stem 130 extending to an operating diaphragm 132. Operating diaphragm 132 forms a portion of an operating pressure chamber 134 closed by a cover 136. Cover 136 has a fitting 138 receiving the operating pressure created by a transducer 140.

Transducer 140 has a control diaphragm 142 clamped between a cover 144 and a transducer housing 146. A port 148 on housing 146 is connected to sense the pressure in the zone 150 of EGR passage 118 downstream of orifice 124, and a port 152 on housing 146 is connected to sense the pressure in the zone 154 of EGR passage 118 between orifices 124 and 125. A switching member 156 is biased by a spring 158 so that a regulating valving land 160 obstructs port 152 and opens port 148 to the control pressure chamber 162 formed by control diaphragm 142 and housing 146. Upon closure of a switch 164, however, a coil 166 is energized to lift magnetically responsive switching member 156 against the bias of spring 158 to a position where regulating valving land 160 obstructs port 148 and opens a passage 168 between port 152 and control pressure chamber 162.

Transducer 140 has a T-fitting 170 with an aperture 171 which senses the pressure signal created at a port 172 in induction passage 112 adjacent the edge of throttle 114 and supplies an operating pressure to fitting 138. Aperture 171 senses the subatmospheric induction passage pressure downstream of throttle 114 during open throttle operation and the substantially atmospheric pressure upstream of throttle 114 during idle and other closed throttle modes of operation.

During operation when coil 166 is deenergized, any increase in pressure in zone 150 is sensed by control pressure chamber 162, and control diaphragm 142 lifts a bleed valve 176 against the bias of a spring 178 to obstruct air flow through an air bleed 180. The operating pressure in chamber 134 is then reduced by the subatmospheric pressure signal sensed through aperture 171, and operating diaphragm 132 is raised against the bias of a spring 184 to lift control valve pintle 128 from valve seat 126. The resulting increase in the exhaust gas recirculation area between control valve pintle 128 and valve seat 126 provides increased exhaust gas recirculation, and the pressure in zone 150 decreases to balance the control pressure in chamber 162 with the reference pressure created by the bias of springs 158 and 178 and atmospheric pressure in chamber 185.

Upon a decrease in pressure in zone 150, control diaphragm 142 lowers bleed valve 176 away from bleed 180 to permit air flow through bleed 180 into chamber 134. The increased operating pressure in chamber 134 then allows spring 184 to lower operating diaphragm 132 and control valve pintle 128 toward valve seat 126. The resulting decrease in the exhaust gas recirculation area reduces exhaust gas recirculation, and the pressure in zone 150 increases to balance the control pressure in chamber 162 with the reference pressure.

When the pressure in zone 150 equals the reference pressure, the flow of exhaust gases into zone 150 varies as a function of the exhaust backpressure in passage 116. Since the exhaust backpressure is a function of the flow through engine 110—that is, a function of the exhaust gas flow through passage 116 and thus the induction air flow through passage 112—exhaust gas recirculation through exhaust gas recirculation passage 118 will be proportional to induction air flow through passage 112.

When coil 166 is energized, the regulating valving land 160 applies the pressure from zone 154 to control pressure chamber 162, and EGR control unit 122 positions control valve pintle 128 to provide exhaust gas recirculation at rates which establish the pressure in zone 154 necessary to maintain the control pressure in chamber 162 equal to the reference pressure. Since the entrance to zone 150 is more restricted than the entrance to zone 154, exhaust gas will be recirculated at a lower rate when the pressure in zone 150 equals a reference pressure than when the pressure in zone 154 equals that reference pressure. Thus exhaust gas recirculation will be a higher proportion of induction air flow when regulating valving land 160 directs the pressure from zone 154 to control pressure chamber 162 than when regulating valving land 160 directs the pressure from zone 150 to control pressure chamber 162.

The operating pressure in chamber 134 is at times dependent upon the subatmospheric induction passage pressure signal received from port 172. During closed throttle operation, port 172 senses the substantially atmospheric pressure upstream of throttle 114, and spring 184 engages control valve pintle 128 with valve seat 126 to interrupt exhaust gas recirculation. During wide open throttle operation, the pressure in induction passage 112 downstream of throttle 114 approaches atmospheric pressure, and spring 184 again engages control valve pintle 128 with valve seat 126 to interrupt exhaust gas recirculation. During a range of part throttle operation, however, variations in the induction passage pressure downstream of throttle 114 do not affect exhaust gas recirculation—for if the operating pressure in chamber 134 causes operating diaphragm 132 to move control valve pintle 128 from that position which provides exhaust gas recirculation at the rate establishing the pressures in EGR passage 118 necessary to maintain the control pressure in chamber 162 equal to the reference pressure, transducer 140 will restore the operating pressure in chamber 134 to the level necessary to return control valve pintle 128 to that position.

It will be appreciated that spring 158 is compressed when coil 166 is energized. The increased bias of spring 158 then reduces the reference pressure on control diaphragm 142 opposing the control pressure in chamber 162. Accordingly, when coil 166 is energized EGR control unit 122 will position control valve pintle 128 to provide exhaust gas recirculation at a rate which establishes a lower pressure in zone 154 than the pressure established in zone 150 when coil 166 is not energized. The increased proportion of exhaust gas recirculation which is provided when coil 166 is energized thus is due both to a lower pressure in the control pressure zone and to a larger orifice between the control pressure zone and the exhaust backpressure in EGR passage 118 upstream of orifice 125.

A screw 186 provides an adjustable stop which is engaged by switching member 156 when coil 166 is not energized. By turning screw 186, the initial force of spring 158 may be adjusted to establish the higher reference pressure.

Fitting 170 is threaded at 188 to adjust the end 190 of air bleed 180 relative to bleed valve 176. This adjustment establishes the distance through which control diaphragm 142 must move bleed valve 176 to obstruct air flow through air bleed 180 and thus establishes the control pressure which must be achieved to overcome the bias of spring 178. Threaded fitting 170 accordingly provides another adjustment for the reference pressure.

The embodiments of the invention in which an exclusive property or privilege is claimed are defined as follows:

1. An exhaust gas recirculation control assembly for an engine having an induction passage for induction air flow and a recirculation passage for exhaust gas recirculation to said induction passage, said assembly comprising means defining a control pressure chamber having a port opening to a pressure zone in said recirculation passage and another port opening to another zone, a valve for modulating at least one of said ports to create a control pressure in said chamber intermediate the pressures in said zones, a control valve in said recirculation passage, and means for operating said control valve to provide exhaust gas recirculation at rates which establish the pressure in said pressure zone necessary to create a control pressure in said chamber equal to a reference pressure, whereby exhaust gas recirculation is provided as a proportion of induction air flow with said proportion being ruled by the modulation of said ports.

2. An exhaust gas recirculation control assembly for an engine having an induction passage for induction air flow and a recirculation passage for exhaust gas recirculation to said induction passage, said assembly comprising means forming two pressure zones in said recirculation passage, means defining a control pressure chamber having ports opening to said zones, a valve for modulating at least one of said ports to create a control pressure in said chamber, a control valve in said recirculation passage, and means for operating said control valve to provide exhaust gas recirculation at rates which establish the pressures in said zones necessary to create a control pressure in said chamber equal to a reference pressure, whereby exhaust gas recirculation is provided as a proportion of induction air flow with said proportion being ruled by the modulation of said ports.

3. An exhaust gas recirculation control assembly for an engine having an induction passage for induction air flow and a recirculation passage for exhaust gas recirculation to said induction passage, said assembly comprising a venturi formed in said recirculation passage and having a restricted zone, means defining a control pressure chamber having a port opening to said restricted zone and having a port opening to a zone of said recirculation passage downstream of said restricted zone, a valve for modulating at least one of said ports to create a control pressure in said chamber, a control valve in said recirculation passage, and means for operating said control valve to provide exhaust gas recirculation at rates which establish the pressures in said zones necessary to create a control pressure in said chamber equal to a reference pressure, whereby exhaust gas recirculation is provided as a proportion of induction air flow with said proportion being ruled by the modulation of said ports.

4. An exhaust gas recirculation control assembly for an engine having an induction passage for induction air flow and a recirculation passage for exhaust gas recirculation to said induction passage, said assembly comprising a small orifice in said recirculation passage forming a pressure zone downstream thereof, a large orifice in said recirculation passage upstream of said small orifice and forming a pressure zone therebetween, means defining a control pressure chamber having ports opening to said zones, a valve for modulating at least one of said ports to create a control pressure in said chamber, a control valve in said recirculation passage, and means for operating said control valve to provide exhaust gas recirculation at rates which establish the pressures in said zones necessary to create a control pressure in said chamber equal to a reference pressure, whereby exhaust gas recirculation is provided as a proportion of induction air flow with said proportion being ruled by the modulation of said ports.

5. An exhaust gas recirculation control assembly for an engine having an induction passage for induction air flow and a recirculation passage for exhaust gas recirculation to said induction passage, said assembly comprising means forming two pressure zones in said recirculation passage, a control valve in said reciculation passage, and means for operating said valve to provide exhaust gas recirculation at rates which at one time maintain the pressure in one of said pressure zones equal to a reference pressure and which at other times maintain the pressure in the other of said pressure zones equal to a reference pressure, whereby exhaust gas recirculation is provided as a proportion of induction air flow with said proportion being higher at said one time than at said other times.

6. An exhaust gas recirculation control assembly for an engine having an induction passage for induction air flow and a recirculation passage for exhaust gas recirculation to said induction passage, said assembly comprising means defining a control pressure chamber, a duty cycle operated valve for connecting said chamber to a pressure zone in said recirculation passage during a portion of the duty cycle and to another zone during the remainder of the duty cycle, a control valve in said recirculation passage, and means for operating said control valve to provide exhaust gas recirculation at rates which establish the pressure in said pressure zone necessary to create a control pressure in said chamber equal to a reference pressure, whereby exhaust gas recirculation is provided as a proportion of induction air flow with said proportion being ruled by the duty cycle.

7. An exhaust gas recirculation control assembly for an engine having an induction passage for induction air flow and a recirculation passage for exhaust gas recirculation to said induction passage, said assembly comprising means forming two pressure zones in said recirculation passage, means defining a control pressure chamber, a duty cycle operated valve for connecting said chamber to one of said pressure zones during a portion of the duty cycle and to the other of said pressure zones during the remainder of the duty cycle, a control valve in said recirculation passage, and means for operating said control valve to provide exhaust gas recirculation at rates which establish the pressures in said zones necessary to create a control pressure in said chamber equal to a reference pressure, whereby exhaust gas recirculation is provided as a proportion of induction air flow with said proportion being ruled by the duty cycle.

8. An exhaust gas recirculation control assembly for an engine having an induction passage for induction air flow and a recirculation passage for exhaust gas recirculation to said induction passage, said assembly comprising means defining a control pressure chamber having a port opening to a pressure zone in said recirculation passage and another port opening to another zone, a valve for modulating at least one of said ports to create a control pressure in said chamber intermediate the pressures in said zones, a valve for regulating an operating pressure in response to a deviation of said control pressure from a reference pressure, and a control valve in said recirculation passage defining an exhaust gas recirculation area in accordance with said operating pressure to provide exhaust gas recirculation at rates which establish the pressure in said pressure zone necessary to create a control pressure in said chamber equal to said reference pressure, whereby exhaust gas recirculation is provided as a proportion of induction air flow with said proportion being ruled by the modulation of said ports.

9. An exhaust gas recirculation control assembly for an engine having an induction passage for induction air flow and a recirculation passage for exhaust gas recirculation to said induction passage, said assembly comprising means forming two pressure zones in said recirculation passage, means defining a control pressure chamber having ports opening to said zones, a valve for modulating at least one of said ports to create a control pressure in said chamber, a valve for regulating an operating pressure in response to a deviation of said control pressure from a reference pressure, and a control valve in said recirculation passage defining an exhaust gas recirculation area in accordance with said operating pressure to provide exhaust gas recirculation at rates which establish the pressures in said zones necessary to create a control pressure in said chamber equal to said reference pressure, whereby exhaust gas recirculation is provided as a proportion of induction air flow with said proportion being ruled by the modulation of said ports.

10. An exhaust gas recirculation control assembly for an engine having an induction passage for induction air flow and a recirculation passage for exhaust gas recirculation to said induction passage, said assembly comprising means forming two pressure zones in said recirculation passage, a valve for regulating an operating pressure in response at one time to a deviation in the pressure in one of said pressure zones from a reference pressure and at other times to a deviation in the pressure in the other of said pressure zones from a reference pressure, and a control valve in said recirculation passage defining an exhaust gas recirculation area in accordance with said operating pressure to provide exhaust gas recirculation at rates which at said one time maintain the pressure in said one pressure zone equal to a reference pressure and at said other times maintain the pressure in said other pressure zone equal to a reference pressure, whereby exhaust gas recirculation is provided as a proportion of induction air flow with said proportion being higher at said one time than at said other times.

11. An exhaust gas recirculation control assembly for an engine having an induction passage for induction air flow and a recirculation passage for exhaust gas recirculation to said induction passage, said assembly comprising means defining a control pressure chamber, a duty cycle operated valve for connecting said chamber to a pressure zone in said recirculation passage during a portion of the duty cycle and to another zone during the remainder of the duty cycle, a valve for regulating an operating pressure in response to a deviation of the control pressure in said chamber for a reference pressure, and a control valve in said recirculation passage defining an exhaust gas recirculation area in accordance with said operating pressure to provide exhaust gas recirculation at rates which establish the pressure in said pressure zone necessary to create a control pressure in said chamber equal to said reference pressure, whereby exhaust gas recirculation is provided as a proportion of induction air flow with said proportion being ruled by the duty cycle.

12. An exhaust gas recirculation control assembly for an engine having an induction passage for induction air flow and a recirculation passage for exhaust gas recirculation to said induction passage, said assembly comprising means forming two pressure zones in said recirculation passage, means defining a control pressure chamber, a duty cycle operated valve for connecting said chamber to one of said pressure zones during a portion of the duty cycle and to the other of said pressure zones during the remainder of the duty cycle, a valve for regulating an operating pressure in response to a deviation of the control pressure in said chamber from a reference pressure, and a control valve in said recirculation passage defining an exhaust gas recirculation area in accordance with said operating pressure to provide exhaust gas recirculation at rates which establish the pressures in said zones necessary to create a control pressure in said chamber equal to said reference pressure, whereby exhaust gas recirculation is provided as a proportion of induction air flow with said proportion being ruled by the duty cycle.

13. An exhaust gas recirculation control assembly for an engine having an induction passage for induction air flow and a recirculation passage for exhaust gas recirculation to said induction passage, said assembly comprising a diaphragm defining a portion of an operating pressure chamber, said chamber having an aperture for sensing a subatmospheric pressure signal and also having an air bleed and combining the pressures sensed through said aperture and said bleed to form an operating pressure, a control valve in said recirculation passage and positioned by said diaphragm to define an exhaust gas recirculation area in inverse relation to said operating pressure, a control diaphragm defining a portion of a control pressure chamber having a port opening to a pressure zone in said recirculation passage and another port opening to another zone, a valve for modulating at least one of said ports to create a control pressure in said control pressure chamber intermediate the pressures in said zones, and a bleed valve positioned by said control diaphragm to obstruct flow through said bleed when said control pressure exceeds a reference pressure, whereby said control valve is positioned to provide exhaust gas recirculation at rates which establish the pressure in said pressure zone necessary to create a control pressure in said control pressure chamber equal to said reference pressure and thus provide exhaust gas recirculation as a proportion of induction air flow with said proportion being ruled by the modulation of said ports.

14. An exhaust gas recirculation control assembly for an engine having an induction passage for induction air flow and a recirculation passage for exhaust gas recirculation to said induction passage, said assembly comprising means forming two pressure zones in said recirculation passage, a diaphragm defining a portion of an operating pressure chamber, said chamber having an aperture for sensing a subatmospheric pressure signal and also having an air bleed and combining the pressures sensed through said aperture and said bleed to form an operating pressure, a control valve in said recirculation passage and positioned by said diaphragm to define an exhaust gas recirculation area in inverse relation to said operating pressure, a control diaphragm defining a portion of a control pressure chamber having ports opening to said zones, a valve for modulating at least one of said ports to create a control pressure in said control pressure chamber, and a bleed valve positioned by said control diaphragm to obstruct flow through said bleed when said control pressure exceeds a reference pressure, whereby said control valve is positioned to provide exhaust gas recirculation at rates which establish the pressures in said zones necessary to create a control pressure in said control pressure chamber equal to said reference pressure and thus provide exhaust gas recirculation as a proportion of induction air flow with said proportion being ruled by the modulation of said ports.

15. An exhaust gas recirculation control assembly for an engine having an induction passage for induction air flow, a recirculation passage for exhaust gas recirculation to said induction passage, a diaphragm defining a portion of an operating pressure chamber, said chamber having an aperture for sensing a subatmospheric pressure signal and also having an air bleed and combining the pressures sensed through said aperture and said air bleed to form an operating pressure, a control valve in said recirculation passage and positioned by said diaphragm to define an exhaust gas recirculation area in inverse relation to said operating pressure, said assembly comprising a control diaphragm defining a portion of a control pressure chamber having a port for sensing the pressure in a pressure zone in said recirculation passage and another port for sensing the pressure in another zone, a valve for modulating at least one of said ports to create a control pressure in said control pressure chamber intermediate the pressures sensed by said ports, and a bleed valve positioned by said control diaphragm for obstructing flow through said bleed when said control pressure exceeds a reference pressure, whereby said control valve may be positioned to provide exhaust gas recirculation at rates which establish the pressure in said pressure zone necessary to create a control pressure in said control pressure chamber equal to said reference pressure and thus provide exhaust gas recirculation as a proportion of induction air flow with said proportion being ruled by the modulation of said ports.

16. An exhaust gas recirculation control assembly for an engine having an induction passage for induction air flow, a recirculation passage for exhaust gas recirculation to said induction passage, means forming two pressure zones in said recirculation passage, a diaphragm defining a portion of an operating pressure chamber, said chamber having an aperture for sensing a subatmospheric pressure signal and also having an air bleed and combining the pressures sensed through said aperture and said air bleed to form an operating pressure, a control valve in said recirculation passage downstream of said zones and positioned by said diaphragm to define an exhaust gas recirculation area in inverse relation to said operating pressure, said assembly comprising a control diaphragm defining a portion of a control pressure chamber having ports for sensing the pressure in said zones, a valve for modulating at least one of said ports to create a control pressure in said control pressure chamber, and a bleed valve positioned by said control diaphragm for obstructing flow through said bleed when said control pressure exceeds a reference pressure, whereby said control valve may be positioned to provide exhaust gas recirculation at rates which establish the pressures in said zones necessary to create a control pressure in said control pressure chamber equal to said reference pressure and thus provide exhaust gas recirculation as a proportion of induction air flow with said proportion being ruled by the modulation of said ports.

17. An improvement in an exhaust gas recirculation control assembly for an engine having an induction passage for induction air flow, a recirculation passage for exhaust gas recirculation to said induction passage, a diaphragm defining a portion of an operating pressure chamber, said chamber having an aperture for sensing a subatmospheric pressure signal and also having an air bleed and combining the pressures sensed through said aperture and said bleed to form an operating pressure, a control valve in said recirculation passage and positioned by said diaphragm to define an exhaust gas recirculation area in inverse relation to said operating pressure, a control diaphragm defining a portion of a control pressure chamber, and a bleed valve positioned by said control diaphragm to obstruct flow through said bleed when the pressure in said control pressure chamber exceeds a reference pressure, said improvement comprising means forming a port opening from said control pressure chamber for sensing the pressure in a pressure zone in said recirculation passage and another port opening from said control pressure chamber for sensing the pressure in another zone, and a valve for modulating at least one of said ports to create a control pressure in said control pressure chamber intermediate the pressures sensed by said ports, whereby said control valve may be positioned to provide exhaust gas recirculation at rates which establish the pressure in said pressure zone necessary to create a control pressure in said control pressure chamber equal to said reference pressure and thus provide exhaust gas recirculation as a proportion of induction air flow with said proportion being ruled by the modulation of said ports.

18. An improvement in an exhaust gas recirculation control assembly for an engine having an induction passage for induction air flow, a recirculation passage for exhaust gas recirculation to said induction passage, a diaphragm defining a portion of an operating pressure chamber, said chamber having an aperture for sensing a subatmospheric pressure signal and also having an air bleed and combining the pressures sensed through said aperture and said bleed to form an operating pressure, a control valve in said recirculation passage and positioned by said diaphragm to define an exhaust gas recirculation area in inverse relation to said operating pressure, a control diaphragm defining a portion of a control pressure chamber, and a bleed valve positioned by said control diaphragm to obstruct flow through said bleed when the pressure in said control pressure chamber exceeds a reference pressure, said improvement comprising means forming two pressure zones in said recirculation passage and ports opening from said control pressure chamber to said zones, and a valve for modulating at least one of said ports to create a control pressure in said control pressure chamber, whereby said control valve is positioned to provide exhaust gas recirculation at rates which establish the pressures in said zones necessary to create a control pressure in said control pressure chamber equal to said reference pressure and thus provide exhaust gas recirculation as a proportion of induction air flow with said proportion being ruled by the modulation of said ports.

19. An exhaust gas recirculation control assembly for an engine having an induction passage for induction air flow and a recirculation passage for exhaust gas recirculation to said induction passage, said assembly comprising means forming two pressure zones in said recirculation passage, a diaphragm defining a portion of an operating pressure chamber, said chamber having an aperture for sensing a subatmospheric pressure signal and also having an air bleed and combining the pressures sensed through said aperture and said bleed to form an operating pressure, a control valve in said recirculation passage downstream of said zones and positioned by said diaphragm to define an exhaust gas recirculation area in inverse relation to said operating pressure, a control diaphragm defining a portion of a control pressure chamber having means for at one time sensing the pressure in one of said pressure zones and at other times sensing the pressure in the other of said pressure zones, and a bleed valve positioned by said control diaphragm to obstruct flow through said bleed when the pressure sensed by said control pressure chamber exceeds a reference pressure, whereby said control valve is positioned to provide exhaust gas recirculation at rates which at said one time maintain the pressure in said one pressure zone equal to a reference pressure and at said other times maintain the pressure in said other pressure zone equal to a reference pressure and thus provide exhaust gas recirculation as a proportion of induction air flow with said proportion being higher at said one time than at said other times.

20. An exhaust gas recirculation control assembly for an engine having an induction passage for induction air flow and a recirculation passage for exhaust gas recirculation to said induction passage, said assembly comprising a venturi formed in said recirculation passage and having a restricted zone and an expanded zone, a diaphragm defining a portion of an operating pressure chamber, said chamber having an aperture for sensing a subatmospheric pressure signal and also having an air bleed and combining the pressures sensed through said aperture and said bleed to form an operating pressure, a control valve in said recirculation passage downstream of said zones and positioned by said diaphragm to define an exhaust gas recirculation area in inverse relation to said operating pressure, a control diaphragm defining a portion of a control pressure chamber having means for at one time sensing the pressure in one of said zones and at other times sensing the pressure in the other of said zones, and a bleed valve positioned by said control diaphragm to obstruct flow through said bleed when the pressure sensed by said control pressure chamber exceeds a reference pressure, whereby said control valve is positioned to provide exhaust gas recirculation at rates which at said one time maintain the pressure in said one zone equal to a reference pressure and at said other times maintain the pressure in said other zone equal to a reference pressure and thus provide exhaust gas recirculation as a proportion of induction air flow with said proportion being higher at said one time than at said other times.

21. An exhaust gas recirculation control assembly for an engine having an induction passage for induction air flow and a recirculation passage for exhaust gas recirculation to said induction passage, said assembly comprising a small orifice in said recirculation passage and forming a pressure zone downstream thereof, a large orifice in said recirculation passage upstream of said small orifice and forming a pressure zone therebetween, a diaphragm defining a portion of an operating pressure chamber, said chamber having an aperture for sensing a subatmospheric pressure signal and also having an air bleed and combining the pressures sensed through said aperture and said bleed to form an operating pressure, a control valve in said recirculation passage downstream of said pressure zones and positioned by said diaphragm to define an exhaust gas recirculation area in inverse relation to said operating pressure, a control diaphragm defining a portion of a control pressure chamber having means for at one time sensing the pressure in one of said pressure zones and at other times sensing the pressure in the other of said pressure zones, and a bleed valve positioned by said control diaphragm to obstruct flow through said bleed when the pressure sensed by said control pressure chamber exceeds a reference pressure, whereby said control valve is positioned to provide exhaust gas recirculation at rates which at said one time maintain the pressure in said one pressure zone equal to a reference pressure and at said other times maintain the pressure in said other pressure zone equal to a reference pressure and thus provide exhaust gas recirculation as a proportion of induction air flow with said proportion being higher at said one time than at said other times.

22. An exhaust gas recirculation control assembly for an engine having an induction passage for induction air flow and a recirculation passage for exhaust gas recirculation to said induction passage, said assembly comprising a diaphragm defining a portion of an operating pressure chamber, said chamber having an aperture for sensing a subatmospheric pressure signal and also having an air bleed and combining the pressures sensed through said aperture and said bleed to form an operating pressure, a control valve in said recirculation passage and positioned by said diaphragm to define an exhaust gas recirculation area in inverse relation to said operating pressure, a control diaphragm defining a portion of a control pressure chamber, a duty cycle operated valve for connecting said control pressure chamber to a pressure zone in said recirculation passage upstream of said valve during a portion of the duty cycle and to another zone during the remainder of the duty cycle, and a bleed valve positioned by said control diaphragm to obstruct flow through said bleed when the pressure in said control pressure chamber exceeds a reference pressure, whereby said control valve is positioned to provide exhaust gas recirculation at rates which establish the pressure in said pressure zone necessary to create a control pressure in said chamber equal to said reference pressure and thus provide exhaust gas recirculation as a proportion of induction air flow with said proportion being ruled by the duty cycle.

23. An exhaust gas recirculation control assembly for an engine having an induction passage for induction air flow and a recirculation passage for exhaust gas recirculation to said induction passage, said assembly comprising means forming two pressure zones in said recirculation passage, a diaphragm defining a portion of an operating pressure chamber, said chamber having an aperture for sensing a subatmospheric pressure signal and also having an air bleed and combining the pressures sensed through said aperture and said bleed to form an operating pressure, a control valve in said recirculation passage downstream of said pressure zones and positioned by said diaphragm to define an exhaust gas recirculation area in inverse relation to said operating pressure, a control diaphragm defining a portion of a control pressure chamber, a duty cycle operated valve connecting said control pressure chamber to one of said pressure zones during a portion of the duty cycle and to the other of said pressure zones during the remainder of the duty cycle, and a bleed valve positioned by said control diaphragm to obstruct flow through said bleed when the pressure in said control pressure chamber exceeds a reference pressure, whereby said control valve is positioned to provide exhaust gas recirculation at rates which establish the pressures in said zones necessary to create a control pressure in said chamber equal to said reference pressure and thus provide exhaust gas recirculation as a proportion of induction air flow with said proportion being ruled by the duty cycle.

24. An exhaust gas recirculation control assembly for an engine having an induction passage for induction air flow and a recirculation passage for exhaust gas recirculation to said induction passage, said assembly comprising a venturi formed in said recirculation passage and having a restricted zone, a diaphragm defining a portion of an operating pressure chamber, said chamber having an aperture for sensing a subatmospheric pressure signal and also having an air bleed and combining the pressures sensed through said aperture and said bleed to form an operating pressure, a control valve in said recirculation passage downstream of said venturi and positioned by said diaphragm to define an exhaust gas recirculation area in inverse relation to said operating pressure, a control diaphragm defining a portion of a control pressure chamber, a duty cycle operated valve connecting said control pressure chamber to said restricted zone during a portion of the duty cycle and to the zone of said recirculation passage between said restricted zone and said control valve during the remainder of the duty cycle, and a bleed valve positioned by said control diaphragm to obstruct flow through said bleed when the pressure in said control pressure chamber exceeds a reference pressure, whereby said control valve is positioned to provide exhaust gas recirculation at rates which establish the pressures in said zones necessary to create a control pressure in said chamber equal to said reference pressure and thus provide exhaust gas recirculation as a proportion of induction air flow with said proportion being ruled by the duty cycle.

25. An exhaust gas recirculation control assembly for an engine having an induction passage for induction air flow and a recirculation passage for exhaust gas recirculation to said induction passage, said assembly comprising a small orifice in said recirculation passage and forming a pressure zone downstream thereof, a large orifice in said recirculation passage upstream of said small orifice and forming a pressure zone therebetween, a diaphragm defining a portion of an operating pressure chamber, said chamber having an aperture for sensing a subatmospheric pressure signal and also having an air bleed and combining the pressures sensed through said aperture and said bleed to form an operating pressure, a control valve in said recirculation passage downstream of said pressure zones and positioned by said diaphragm to define an exhaust gas recirculation area in inverse relation to said operating pressure, a control diaphragm defining a portion of a control pressure chamber, a duty cycle operated valve connecting said control pressure chamber to one of said pressure zones during a portion of the duty cycle and to the other of said pressure zones during the remainder of the duty cycle, and a bleed valve positioned by said control diaphragm to obstruct flow through said bleed when the pressure in said control pressure chamber exceeds a reference pressure, whereby said control valve is positioned to provide exhaust gas recirculation at rates which establish the pressures in said zones necessary to create a control pressure in said chamber equal to said reference pressure and thus provide exhaust gas recirculation as a proportion of induction air flow with said proportion being ruled by the duty cycle.

26. The method of controlling exhaust gas recirculation in an engine having an induction passage for induction air flow, a recirculation passage for exhaust gas recirculation to said induction passage, and a control valve in said recirculation passage, said method comprising the steps of:

modulating a port between a control pressure chamber and a pressure zone in said recirculation passage and a port between said chamber and another zone to create a control pressure in said chamber intermediate the pressures in said zones, and operating said valve to provide exhaust gas recirculation at rates which establish the pressure in said pressure zone necessary to create a control pressure in said chamber equal to a selected reference pressure and thus provide exhaust gas recirculation as a proportion of induction air flow with said proportion being ruled by the modulation of said ports.

27. The method of controlling exhaust gas recirculation in an engine having an induction passage for induction air flow, a recirculation passage for exhaust gas recirculation to said induction passage, and a control valve in said recirculation passage, said method comprising the steps of:

creating a control pressure which at one time equals the pressure in one pressure zone in said recirculation passage and at other times equals the pressure in another pressure zone in said recirculation passage, and operating said valve to provide exhaust gas recirculation at rates which establish the pressures in said zones necessary to create a control pressure in said chamber equal to a selected reference pressure and thus provide exhaust gas recirculation as a proportion of induction air flow with said proportion being higher at said one time than at said other times.

28. The method of controlling exhaust gas recirculation in an engine having an induction passage for induction air flow, a recirculation passage for exhaust gas recirculation to said induction passage, and a control valve in said recirculation passage, said method comprising the steps of:

creating a control pressure in a control pressure chamber by opening a port between said chamber and a pressure zone in said recirculation passage during a portion of a duty cycle and by opening a port between said chamber and another zone during the remainder of the duty cycle, and operating said valve to provide exhaust gas recirculation at rates which establish the pressure in said pressure zone necessary to create a control pressure in said chamber equal to a selected reference pressure and thus provide exhaust gas recirculation as a proportion of induction air flow with said proportion being ruled by the duty cycle.

* * * * *